US005101333A

United States Patent [19]

Glassford

[11] Patent Number: 5,101,333

[45] Date of Patent: Mar. 31, 1992

[54] UTILITY LIGHT

[76] Inventor: Joseph B. Glassford, 620 N. Arbogast St., Griffith, Ind. 46319

[21] Appl. No.: 585,476

[22] Filed: Sep. 20, 1990

[51] Int. Cl.[5] ..... F21S 1/12

[52] U.S. Cl. ..... 362/413; 362/396; 362/398; 362/395; 362/414

[58] Field of Search ..... 362/186, 191, 198, 396, 362/398, 378, 413, 414, 395

[56] References Cited

U.S. PATENT DOCUMENTS

| | | | |
|---|---|---|---|
| 2,247,022 | 6/1941 | Hovorka | 362/396 |
| 2,360,420 | 10/1944 | Hill | 240/1.2 |
| 2,598,310 | 5/1952 | Schaser | 362/395 |
| 2,899,540 | 8/1959 | Allmand et al. | 240/10.5 |
| 3,026,409 | 3/1962 | Deisch | 240/1.3 |
| 3,147,928 | 9/1964 | Carpenter | 362/395 X |
| 3,187,170 | 6/1965 | Kille | 240/1.3 |
| 3,875,396 | 4/1975 | Webb | 240/6.4 B |
| 3,944,806 | 3/1976 | Jones et al. | 240/10.6 R |
| 3,997,776 | 12/1976 | Ruud | 240/2 SL |
| 4,288,848 | 9/1981 | Fido | 362/398 X |
| 4,419,658 | 12/1983 | Jarosz et al. | 340/521 |

FOREIGN PATENT DOCUMENTS

| | | | |
|---|---|---|---|
| 165834 | 4/1950 | Austria | 362/396 |

*Primary Examiner*—Stephen F. Husar
*Attorney, Agent, or Firm*—Olson & Hierl

[57] ABSTRACT

A utilitiy light includes means for removably mounting a light source on a surface and a flexible gooseneck portion having a first end connected to the mounting means and second end connected to the light source. A control switch and a power source are in electrical communication with the light source.

7 Claims, 1 Drawing Sheet

UTILITY LIGHT

TECHNICAL FIELD

The present invention relates to light fixtures and, in particular, to a utility light which effectively directs light into constricted work areas.

BACKGROUND OF THE INVENTION

One of the essential requirements for detailed or close work is adequate lighting. Unfortunately, providing adequate lighting in a restricted workspace is often a problem. A good example is a mechanic working on an automobile. With the general trend in downsizing and the considerable number of components found on late model automobiles, the available workspace is very limited.

The amount of general lighting usually available in a garage is insufficient for close work. The shadows cast by the many components in an automobile make working without directed illumination nearly impossible.

One option has been the conventional shop light which includes a light bulb surrounded on one side by a protective cage and on the other side by a reflective plate. The light bulb can be either a conventional household light bulb or a reinforced filament "rough service" light bulb. The light bulb can be clear or frosted. A hook is usually provided for hanging the light from an overhead support. The hook is either a fixed device or a swivel device attached to the reflective plate or the protective cage. The shop light hangs by the hook and is oriented by the mechanic to direct the light as needed. Unfortunately, often suitable locations for the hook are not found. An electrical power cord runs from the side opposite the hook to an electrical outlet.

Shop lights are adequate for general work, but do not provide adequate light for working in constricted areas. Moreover, these types of lights are usually too large and cumbersome to fit into constricted workspaces. As a result, light cannot be directed into the desired locations because of obstructions or the physical size of the components. In view of these limitations, mechanics often work solely by touch. In addition to being time consuming, obvious safety hazards result from such practices.

Additionally, shop lights emit light in a full half circle or more, rather than concentrating it on desired locations. This light "overspray" is very distracting to a mechanic and can cause eye irritation. The eye irritation can also lead to time consuming and dangerous working conditions.

A utility light is needed which provides direct lighting in constricted work areas. The device should be easy to use and have a durable construction. The device described herein meets these needs.

SUMMARY OF THE INVENTION

The present invention relates to a utility light which can be mounted adjacent to a work area to provide direct lighting in a constricted workspace. The device can be mounted on a flat surface, on a cylindrical surface such as along the length of a hose or by magnetic means to a metal surface.

The device includes a light source and comprises means for removably mounting the light source on a surface, a flexible gooseneck portion having a first end connected to the mounting means and a second end connected to the light source, and means for controlling the light source including circuit means in electrical communication with the light source.

The mounting means securely but removably secures the device to the surface. The flexible gooseneck portion can be of various lengths and can be manipulated into a variety of positions and orientations. The second end of the flexible portion includes the light source which can be adjusted until the light from the light source is directed to the desired location. The flexible portion allows easy manipulation yet is rigid enough to maintain the light stationary once it has been positioned.

The controlling means can comprise an electrical switch including a three-way switch or a rheostat which is located at the mounting means, the light source or the electrical power source. This enables the user to operate the light from any desired location.

BRIEF DESCRIPTION OF THE DRAWINGS

In the accompanying drawings, which form a portion of this disclosure.

DESCRIPTION OF A PREFERRED EMBODIMENT

The device of this invention can be assembled and used in many different forms. This detailed description and the accompanying drawings disclose only one specific form which provides an example of a preferred embodiment of the present device. The particular shapes and sizes of the components described are not essential to the invention unless otherwise indicated. Moreover, the invention is not intended to be limited to the embodiment illustrated.

Figure 1:
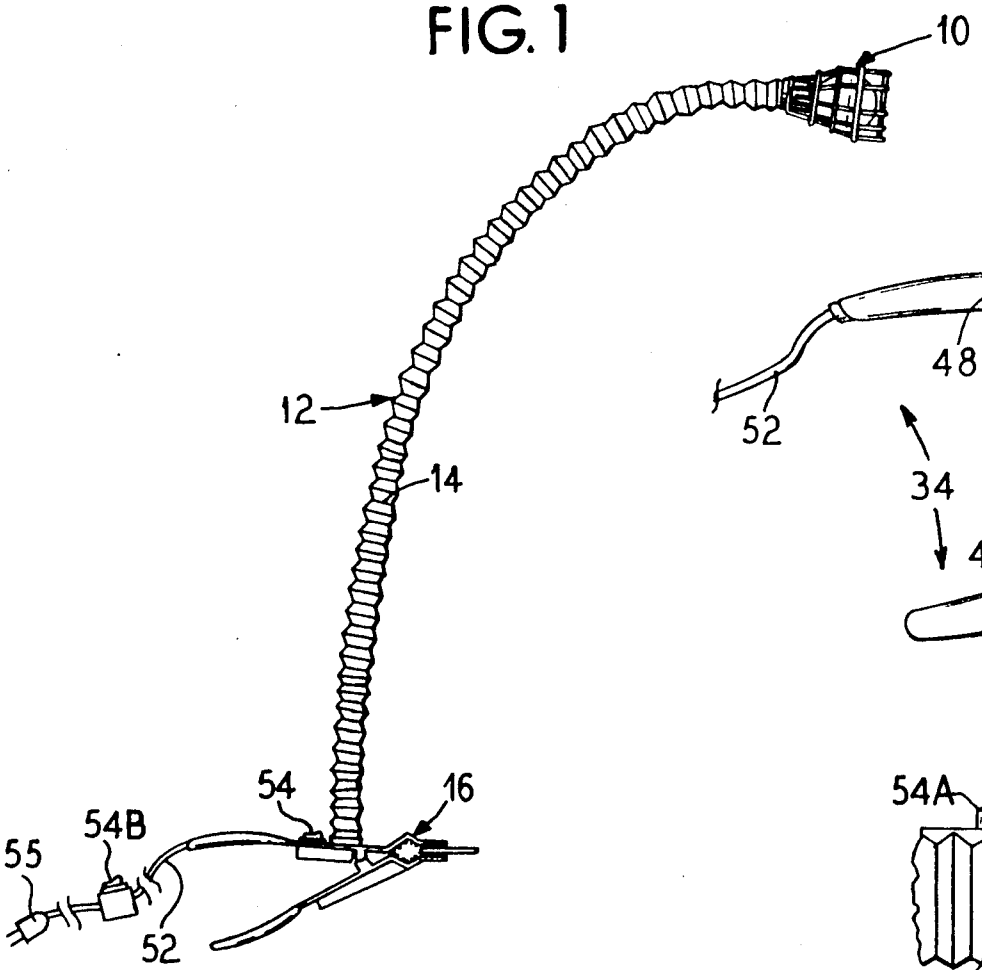
FIG. 1 is a side view of one embodiment of the present utility light.

For ease of reference, the present device is described in a normal operating position. It will be understood, however, that the device may be used in an orientation other than the particular position described. The present invention can best be seen in FIG. 1. The device includes a light source 10. Operatively connected to the light source 10 is a flexible gooseneck portion 12. The gooseneck portion 12 preferably comprises a tube 14 which is flexible enough to be easily positioned by hand. However, the tube 14 is also rigid enough to completely support its own weight and the weight of the light source 10 and thus remain stationary once it is adjusted to a desired position. Such conventional gooseneck portions are well-known to those skilled in the art.

Figure 2:
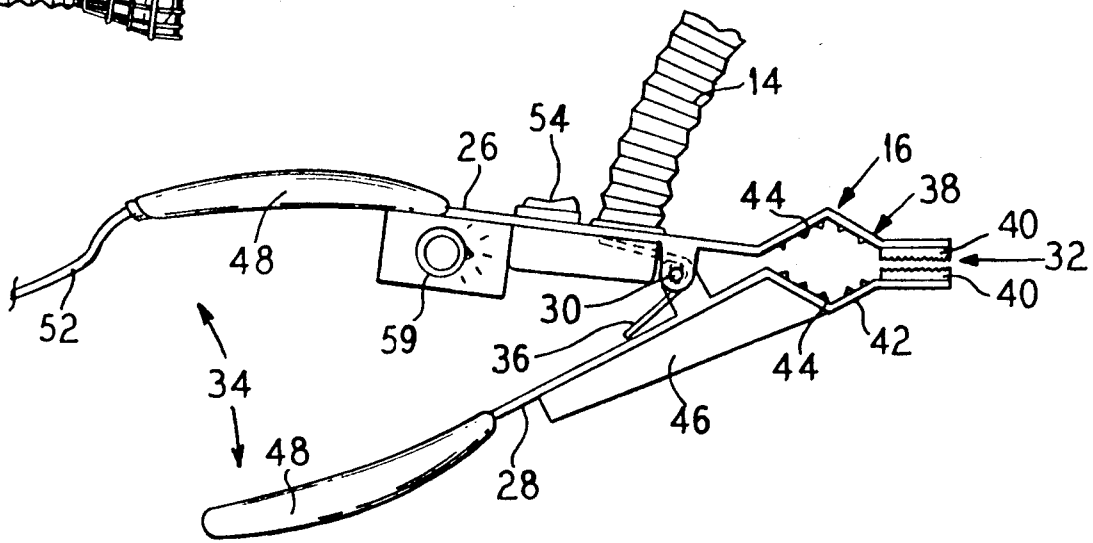
FIG. 2 is an enlarged side view of the mounting means.

The end of gooseneck portion 12 opposite the light source 10 is connected to a clamp 16. The clamp 16 is better illustrated in FIG. 2.

The clamp 16 preferably includes a first handle 26 and a second handle 28. The handles 26 and 28 include clamping ends 32 and gripping ends 34. The first handle 26 and the second handle 28 are joined at a pivot point 30 which is positioned between the ends 32 and 34. A spring 36 is mounted at the pivot point 30 and has sufficient strength to keep the clamping ends 32 together in a closed position.

The clamping ends 32 preferably include two sets of jaws 38. The first set comprises mating flat jaws 40 which are mounted on the handles 26 and 28. The flat jaws 40 cooperate to clamp the device to flat surfaces such as the hood or fender of an automobile.

The clamping ends 32 also preferably include mating open jaws 40 which are mounted on the handles 26 and 28. Open jaws 42, which can include a plurality of substantially parallel ridges or teeth 44, cooperate to clamp the device to cylindrical pieces such as hoses, pipes or axles. As another embodiment, a plurality of open jaws 42 may be mounted on handles 26 and 28 to provide clamping ability to cylindrical pieces of varying diameters.

In an alternative embodiment, a magnet 46 is also mounted on the second handle 28. The magnet 46 can be used for mounting the device on magnetic surfaces, such as a cast iron engine block or other various ferrous metal parts.

The gripping ends 34 preferably include matching grips 48. When the grips 48 are pushed together, the handles 26 and 28 pivot about the pivot point 30, thus separating the jaws 38 at the clamping ends 32. This allows the engagement or disengagement of the clamp 16 from various surfaces as desired. When the grips 48 are released, the tension from spring 36 forces the grips 48 apart and the jaws 38 together.

The tube 14 is preferably mounted on the first handle 26 proximate to the pivot point 30 and between the pivot point 30 and the grip 48. An on-off switch 54 is mounted on the first handle 26 between the flexible tube 14 and the grip 48. The on-off switch 54 may be any usual configuration such as toggle, push-push or snap switch. As an alternative embodiment, electrical sockets can be mounted with the on-off switch 54 to provide an extension cord capability for a mechanic. An electrical cord 52 is preferably attached to the first handle 26 at the gripping end 34. The electrical cord 52 is preferably a standard cord with a plug 55 for insertion into standard electric sockets.

The electrical cord 52 is generally in electrical communication with the on-off switch 54 and the light source 10. Other electrical arrangements to control the light including 3-way switches or a rheostat intensity control 59 for light source 10 are well-known in the art and may also be employed.

Figure 3:
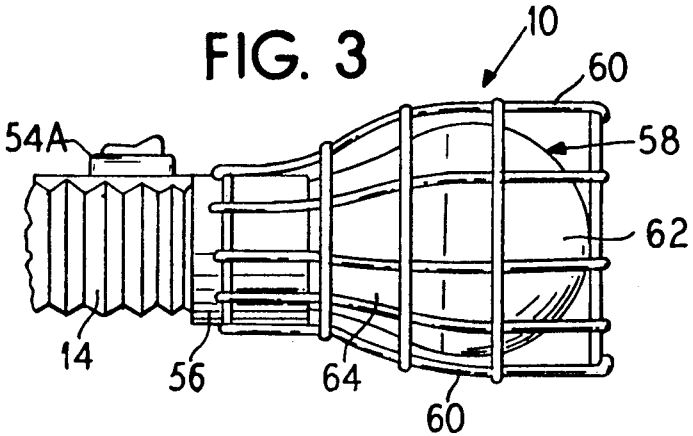
FIG. 3 is an enlarged side view of the light source.

Referring to FIG. 3, an electric light socket 56 is secured to the tube 14. A light bulb 58 is removably mounted within the light socket 56. Attached to the light socket 56 is a protective cage 60 which prevents damage to the light bulb 58 by accidental contact. The cage 60 is preferably made from a high impact resistent, low heat retensive plastic, a plastic-coated metal or simply an appropriate metal. Moreover, the cage 60 can comprise an open grid-like housing as illustrated, or can be open at one end only. In that event, at least some holes should be provided in the housing for the circulation of air.

The light bulb 58 includes a clear or preferably frosted front portion 62 and a reflective rear portion 64. Using a frosted front portion 62 produces a softer light and also eliminates shadows cast by the filament. The reflective rear portion 64 is preferably silver deposited on the interior hemisphere of the light bulb 58 which is mounted proximate to the light socket 56. The rear portion 64 thereby directs the light through the front portion 62 in a direction opposite the tube 14. This allows for direct aiming of the device and the light during use. The light bulb 58 preferably has at least 440 lumens output.

In addition, a second switch 54A can be included adjacent the light socket 56 to allow the light bulb 58 to be turned on and off from either the switch 54 located on the clamp 16 or the switch 54A located adjacent the light socket 56.

In still another embodiment, the second switch 54B may be mounted on the electric cord 52 proximate to the plug 55 and the electrical power source. This permits the utility light to be placed into very constricted areas while still permitting easy control. In the event the mechanic's work is interrupted, the utility light may be switched on and off without any danger of disturbing its location.

The foregoing illustrates the general principles of this invention. However, since numerous modifications and changes will be readily apparent to those skilled in the art based on this description, it is not desired to limit the invention to the exact construction and operation shown and described. Accordingly, the scope of this invention includes other modifications and equivalents that fall within the scope of the foregoing description and the following claims.

What is claimed is:

1. A utility light for a constricted work area or the like comprising in combination:

(a) a light bulb receiving electrical socket member and bulb-protective means in association therewith;

(b) a pincer-type clamp means having two elongated arms disposed in adjacent spatial relationship to one another, each arm having a handle portion and a longitudinally adjacent jaw portion with a projecting lug portion therebetween, said arms being pivotally interconnected together by pin means extending through said respective lug portions at a cross over location therebetween so that said respective jaw portions articulate and matingly engage one another when closed, and further having spring means adjacent said pin means which yieldingly biases said jaw portions into a normally closed engagement;

(c) each one of said jaw portions having a terminal flat region and a longitudinally adjacent arcuate region so that when said jaw portions are closed said respective flat regions are in contacting relationship and said respective arcuate regions define an open channel therebetween;

(d) a flexible, elongated gooseneck member interconnected at one end thereof with a base portion of said socket member and at the opposite end thereof with a mid-outer surface portion of one of said elongated arms, including interconnection means therefor;

(e) electrical cord means functionally connected to said socket member at one end thereof, and extending from said socket member through said gooseneck member, then along said one elongated arm, and finally outwardly away from said handle portion of said one elongated arm; and (f) first electrical on-off switch means functionally associated with said cord means and mounted against said one elongated arm, including mounting means therefor.

2. The utility light of claim 1 wherein said socket member is functionally associated with a light bulb.

3. The utility light according to claim 2 wherein the light bulb further includes a reflective rear portion which substantially directs the light in a forward direction.

4. The utility light according to claim 3 wherein the light bulb has at least a 440 lumen output.

5. The utility light of claim 1 wherein the other of said elongated arms is associated with magnet means including mounting means therefor.

6. The utility light of claim 1 wherein said socket member is functionally provided with a second electrical on-off switch means so that said socket member can be electrically energized by either said first on-off switch means or said second on-off switch means.

7. The utility light of claim 1 wherein said first on-off switch means includes associated rheostat intensity control means.

* * * * *